US006938524B2

(12) United States Patent
Hsien

(10) Patent No.: US 6,938,524 B2
(45) Date of Patent: Sep. 6, 2005

(54) ENGAGING RECESS FOR SOCKETS

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 0 days.

(21) Appl. No.: 10/718,631

(22) Filed: Nov. 24, 2003

(65) Prior Publication Data

US 2005/0109166 A1 May 26, 2005

(51) Int. Cl.[7] ..... B25B 13/00
(52) U.S. Cl. ..... 81/124.6
(58) Field of Search ..... 81/121.1, 124.6, 81/124.7, 185

(56) References Cited

U.S. PATENT DOCUMENTS 3,079,819 A * 3/1963 Wing ..... 81/124.6
3,314,318 A * 4/1967 Shoults ..... 81/124.6
3,433,108 A * 3/1969 Ondeck ..... 81/124.6
3,675,516 A * 7/1972 Knudsen et al. ..... 81/124.6
4,100,824 A * 7/1978 Marschke ..... 81/124.6
4,126,063 A * 11/1978 Palmer ..... 81/124.6
6,029,756 A * 2/2000 Britzke et al. ..... 175/57
6,382,053 B1 * 5/2002 Macor ..... 81/121.1
2003/0097909 A1 * 5/2003 Pote

* cited by examiner

*Primary Examiner*—Jacob K. Ackun, Jr.

(57) ABSTRACT

A socket includes a tubular body having a receiving recess in a first end thereof so as to be connected with a driving end of a wrench, and an engaging recess is defined in a second end of the tubular body so as to be mounted to a bolt head or a nut. The engaging recess has 24 or 36 points equal-angularly extending from an inner periphery of the engaging recess. An opening between two adjacent points is smaller than a width between two respective root portions of the two adjacent points.

3 Claims, 6 Drawing Sheets

ENGAGING RECESS FOR SOCKETS

FIELD OF THE INVENTION

The present invention relates to a socket having an engaging recess with 24 or 36 points so as to mount any type of object.

BACKGROUND OF THE INVENTION

A conventional socket for driving bolt head or nut generally includes a tubular body with a receiving recess at one end of the tubular body so as to be connected with a ratchet tool and an engaging recess is defined in the other end of the tubular body such that a bolt head or a nut can be mounted by the engaging recess and driven. There are so many shapes for the bolt head or the nut, such as hexagonal head which can be seen in most of the bolts, square head, star-shaped bolt head, or toothed bolt head which is only driven by special tool. Furthermore, metric sized and English sized bolt heads are slightly different so that the users need to prepare two different size systems of tools to successfully drive these bolt heads. Using a metric-sized socket to drive an English sized bolt head could damage the peaks of the bolt head or the peaks are not well positioned in the engaging recess so that when rotating the socket, the bolt head is driven at only a limited angle, and this is not efficient.

The present invention intends to provide a socket that includes 24 or 36 points and an opening between two adjacent points is smaller than a width between the root portions of the two adjacent points. By this arrangement, the socket may successfully drive any type of bolt head or nut.

SUMMARY OF THE INVENTION

The present invention relates to a socket that has a tubular body having a receiving recess defined in a first end thereof so as to be connected with a driving end of a wrench, and an engaging recess is defined in a second end of the tubular body. The engaging recess has at least twenty four points equal-angularly extending from an inner periphery of the engaging recess. An opening between two adjacent points is smaller than a width between two respective root portions of the two adjacent points.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
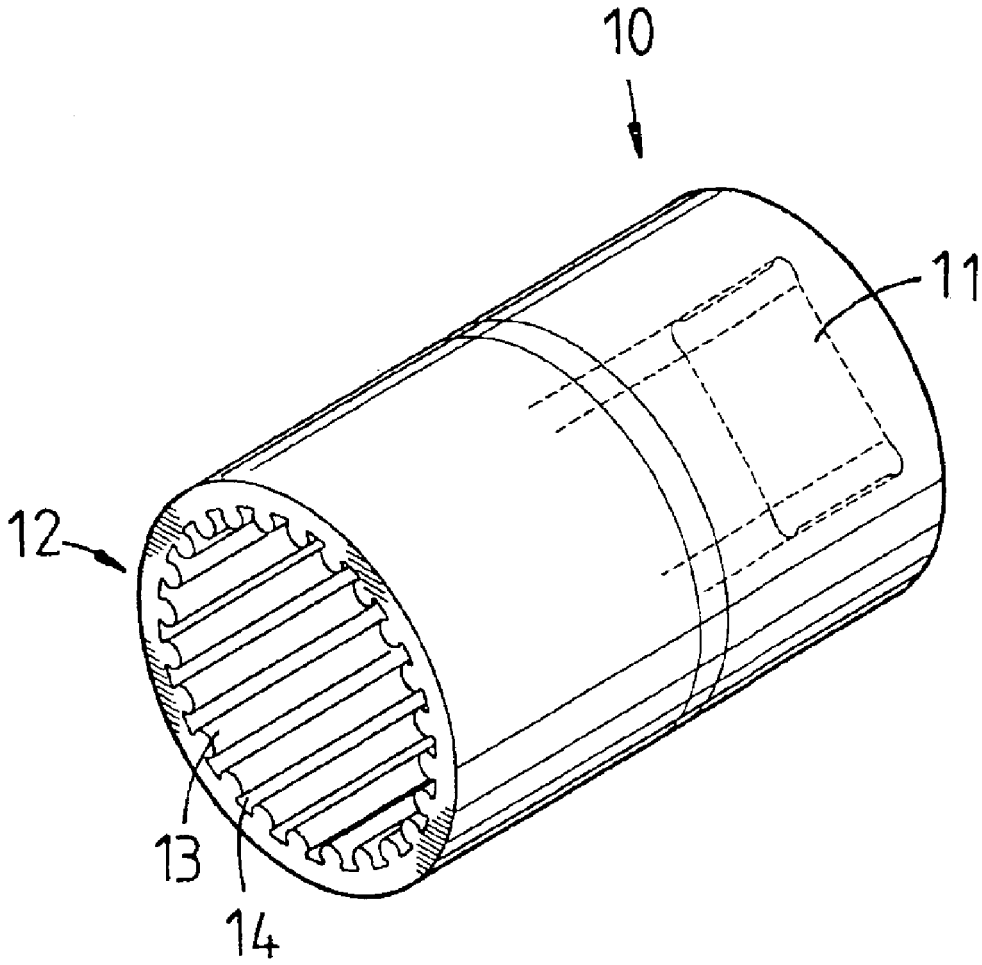
FIG. 1 is a perspective view to show the socket of the present invention.

Referring to FIG. 1, the socket 10 of the present invention comprises a tubular body having a rectangular receiving recess 11 defined in a first end thereof so as to be connected with a driving end of a wrench which is not shown. An engaging recess 12 is defined in a second end of the tubular body and has twenty four points 13 equal-angularly extending from an inner periphery of the engaging recess 12. In other words, there are twenty four grooves 14 defined between the points 13 alternatively. Each of the points 13 has an enlarged section in radial direction thereof and an opening, which is a width between two enlarged sections of the two adjacent points 13 is smaller than a width between two respective root portions of the two adjacent points 13.

Figure 2:
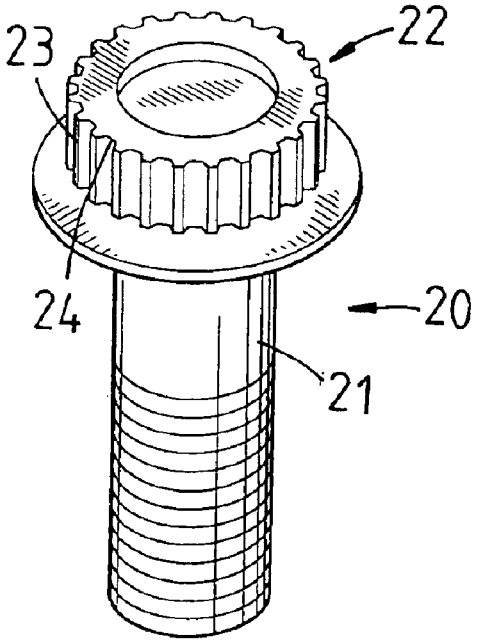
FIG. 2 shows a bolt having a toothed bolt head.
Figure 3:
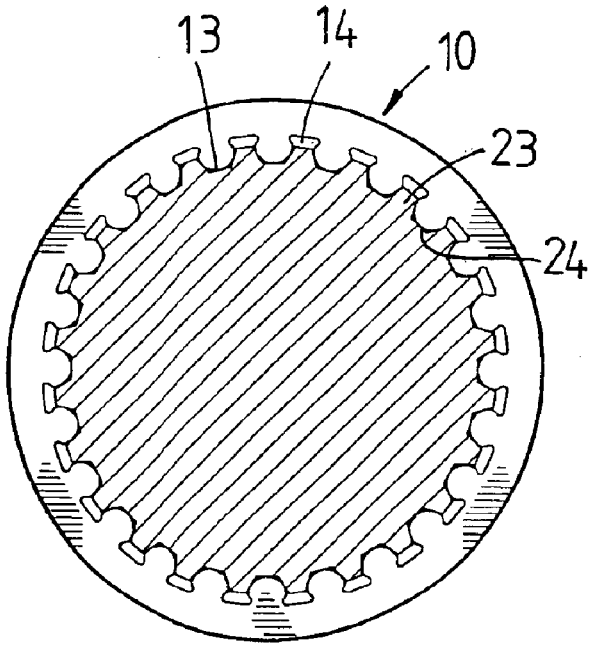
FIG. 3 shows the toothed bolt head is engaged with the engaging recess of the socket of the present invention.

As shown in FIGS. 2 and 3, the bolt 20 includes a threaded shank 21 and a toothed bolt head 22 which includes twenty four peaks 23 and recesses 24 which are located between the peaks 23 alternatively. The toothed bolt head 22 can be engaged with the engaging recess 12 with the peaks 23 engaged with the grooves 14 of the socket 10, and each peak 23 being clamped by two adjacent points 13. Therefore, the bolt 20 can be easily and efficiently rotated when rotating the socket 10.

Figure 4:
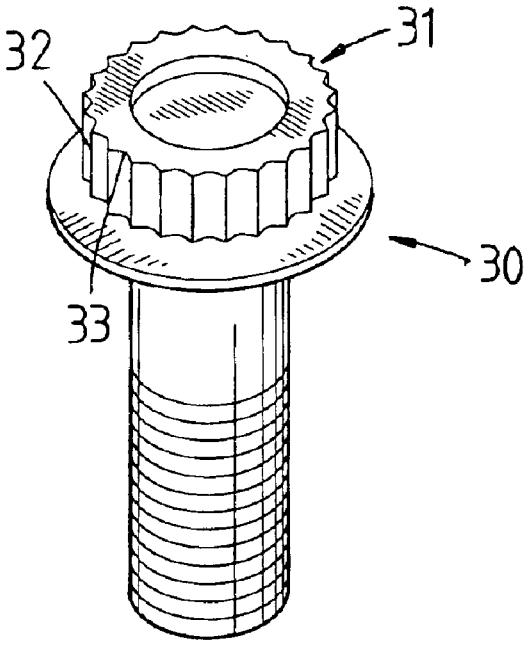
FIG. 4 shows another bolt having a toothed bolt head.
Figure 5:
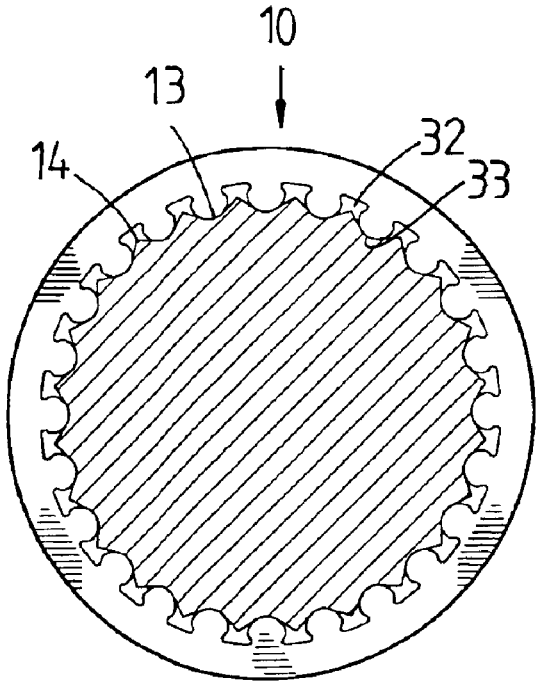
FIG. 5 shows the toothed bolt head as shown in FIG. 4 is engaged with the engaging recess of the socket of the present invention.

Similarly, as disclosed in FIGS. 4 and 5, the bolt 30 has a threaded shank and a toothed bolt head 31 which includes twenty four peaks 32 and recesses 33 which are located between the peaks 32 alternatively. The toothed bolt head 31 can be engaged with the engaging recess 12 with the peaks 32 engaged with the grooves 14 of the socket 10, and each peak 32 being clamped by two adjacent points 13. Therefore, the bolt 30 can also be easily and efficiently rotated when rotating the socket 10.

Figure 6:
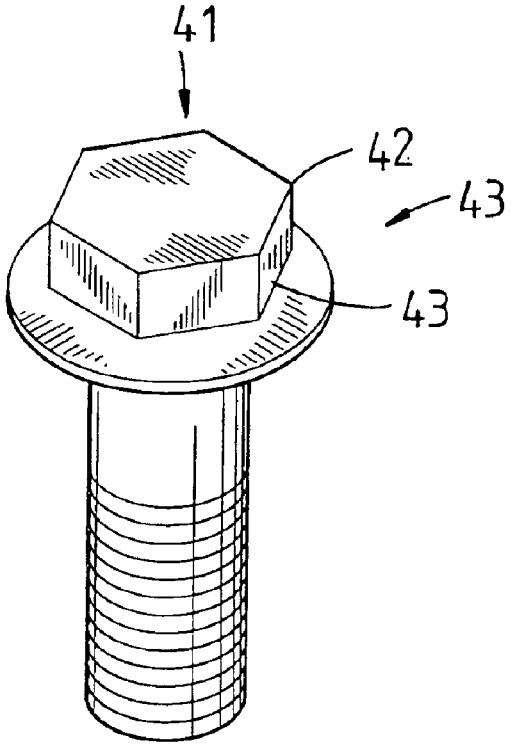
FIG. 6 shows a bolt having a hexagonal bolt head.
Figure 7:
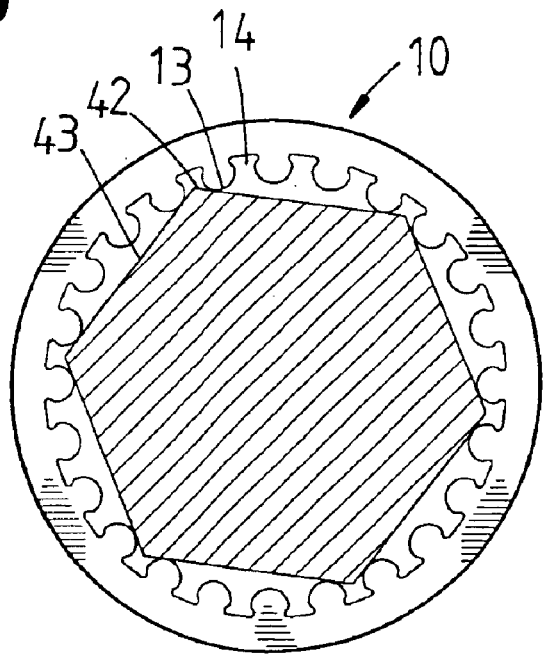
FIG. 7 shows the hexagonal bolt head is engaged with the engaging recess of the socket of the present invention.

Referring to FIGS. 6 and 7, the bolt 43 as disclosed has a threaded shank and a hexagonal bolt head 41 which includes six peaks 42 and sides 43 which are located between the peaks 42 alternatively. The hexagonal bolt head 41 can be engaged with the engaging recess 12 with the peaks 42 engaged with six of the grooves 14 of the socket 10, and two sides 43 forming each peak 42 being clamped by two adjacent points 13. The bolt 43 can also be easily and efficiently rotated when rotating the socket 10.

Figure 8:
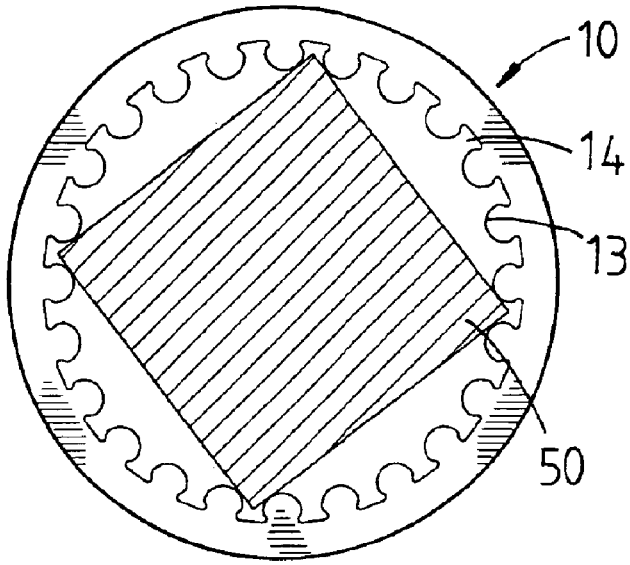
FIG. 8 shows a square bolt head is engaged with the engaging recess of the socket of the present invention.
Figure 9:
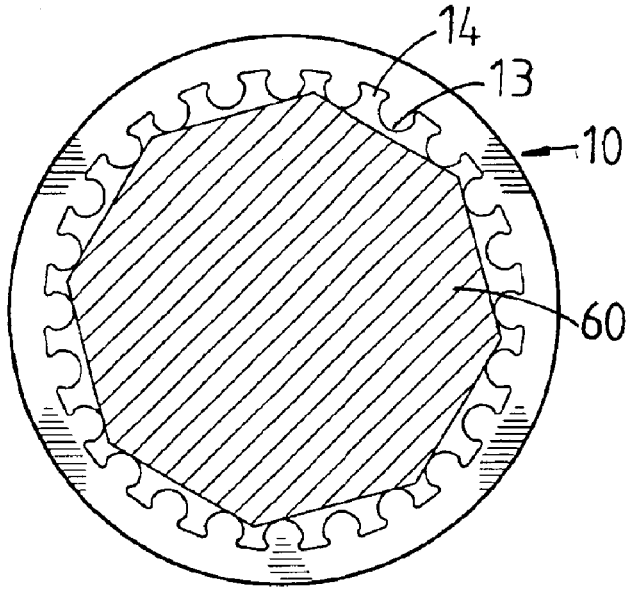
FIG. 9 shows an octagonal bolt head is engaged with the engaging recess of the socket of the present invention.

FIGS. 8 and 9 respectively show that a rectangular bolt head 50 and a octagonal bolt head 60 are easily engaged with the engaging recess 12 of the socket 10.

Figure 10:
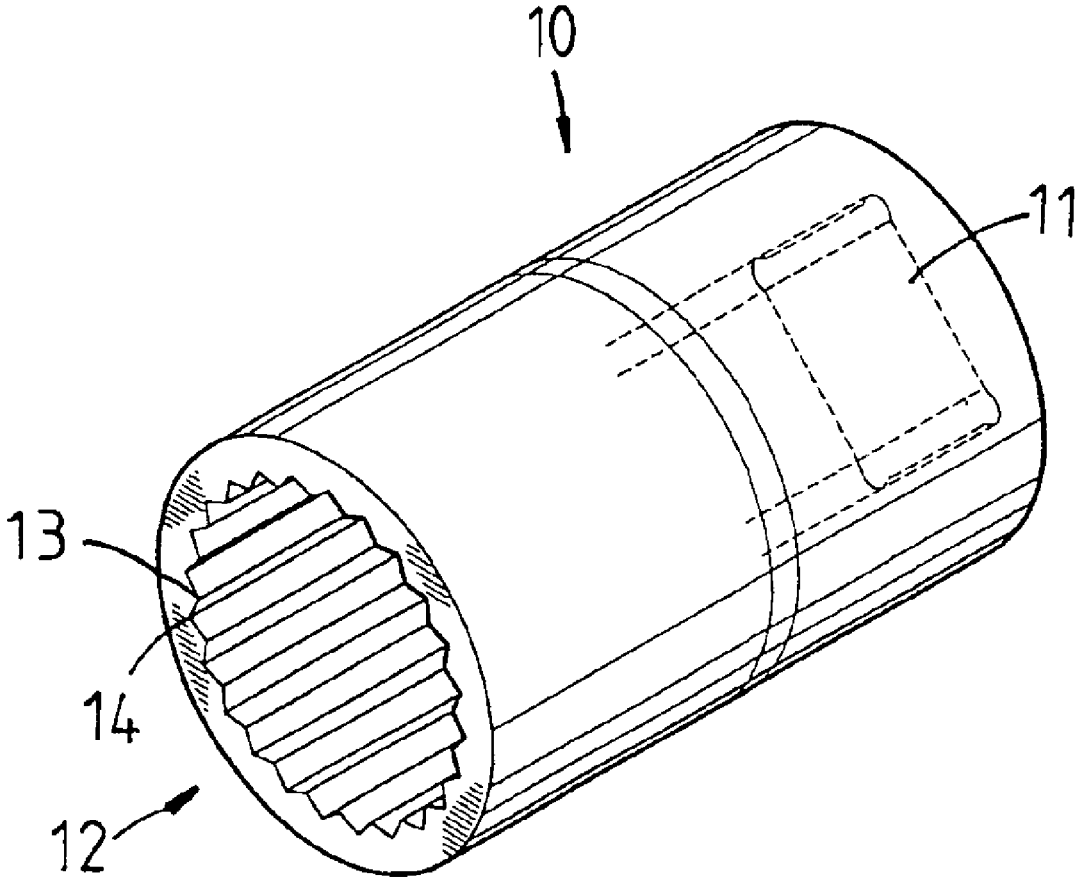
FIG. 10 shows another embodiment of the points of the socket of the present invention.

Further referring to FIG. 10 which shows another embodiment of the present invention, wherein the socket 10 includes a tubular body having a rectangular receiving recess 11 defined in a first end thereof so as to be connected with a driving end of a wrench. An engaging recess 12 is defined in a second end of the tubular body and has at least twenty four points 13 equal-angularly extending from an inner periphery of the engaging recess 12. An opening between two adjacent points 13 is larger than a width between two respective root portions of the two adjacent points 13. This arrangement of the points 13 can also efficiently mounted to the different types of the bolt heads or nuts.

It is to be noted that the number of the points 13 of the socket of the present invention can also be thirty six (36).

While we have shown and described the embodiment in accordance with the present invention, it should be clear to those skilled in the art that further embodiments may be made without departing from the scope of the present invention.

What is claimed is:

1. A socket comprising:

a tubular body having a receiving recess defined in a first end thereof so as to be adapted to be connected with a driving end of a wrench, an engaging recess defined in a second end of the tubular body and having at least twenty four points equal-angularly extending from an inner periphery of the engaging recess, an opening between two adjacent points being smaller than a width between two respective root portions of the two adjacent points.

2. The socket as claimed in claim 1, wherein each of the points has an enlarged section in radial direction thereof and the opening is a width between two enlarged sections of the two adjacent points.

3. The socket as claimed in claim 1, wherein a number of the points is thirty six.

* * * * *